United States Patent [19]

Weeks et al.

[11] 4,024,806

[45] May 24, 1977

[54] TRASH COMPACTOR

[75] Inventors: Charles B. Weeks, Boston; Paul V. Choate, Milton, both of Mass.

[73] Assignee: Norris Industries, Inc., Los Angeles, Calif.

[22] Filed: Feb. 18, 1976

[21] Appl. No.: 659,126

Related U.S. Application Data

[63] Continuation-in-part of Ser. No. 515,675, Oct. 17, 1974, abandoned.

[52] U.S. Cl. ..... 100/52; 74/521; 100/53; 100/229 A; 100/287; 100/290; 100/295; 220/65; 220/94 R

[51] Int. Cl.[2] ..... B30B 15/22

[58] Field of Search ..... 220/65, 94 R; 254/122, 254/126; 74/521, 89.14; 100/229 A, 240, 286, 287, 289, 290, 295, 52, 53

[56] References Cited

UNITED STATES PATENTS

| | | | |
|---|---|---|---|
| 226,101 | 3/1880 | Pfautz | 74/521 X |
| 226,687 | 4/1880 | Tompkins | 100/286 |
| 1,609,333 | 12/1926 | Vesely | 254/126 |
| 1,646,355 | 10/1927 | Hill | 100/290 X |
| 1,673,243 | 6/1928 | Hill | 100/290 X |
| 2,306,723 | 12/1942 | Floraday | 74/89.14 |
| 3,714,890 | 2/1973 | Moon | 100/287 X |
| 3,732,806 | 5/1973 | Bourgeois | 100/295 |
| 3,772,984 | 11/1973 | Karls et al. | 100/287 X |

*Primary Examiner*—Billy J. Wilhite

[57] ABSTRACT

A trash compactor has a compacting head supported by two sets of links, each set having a pair of links pivotally interconnected by a member common to both pairs and spacing the two sets of links apart. Corresponding ends of the links are pivotally connected to the head and means connect the other ends of the links to the compactor in a manner enabling the linkage to be unfolded to extend the head into a compacting position or retracted therefrom. Vertical screws, rotated by a reversible drive are threaded through the pivot member to effect such folding and unfolding of the linkage. The ends of the pivot member are within vertical guides and the linkage includes stabilizing links connected to the head.

15 Claims, 24 Drawing Figures

FIG. 5
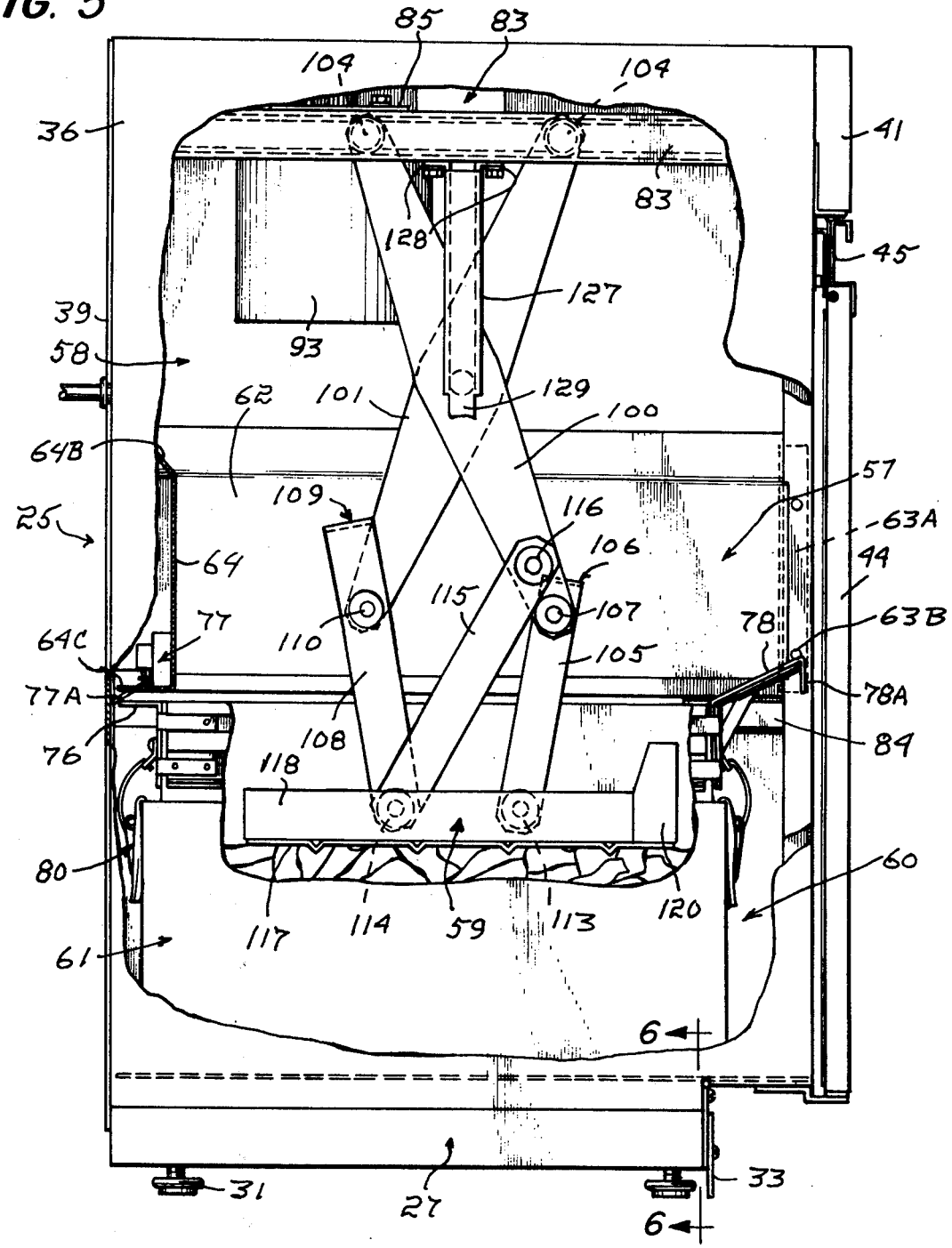
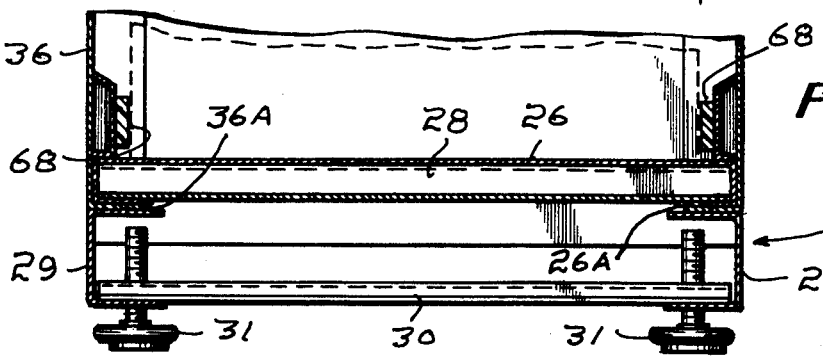
FIG. 6

FIG. 11
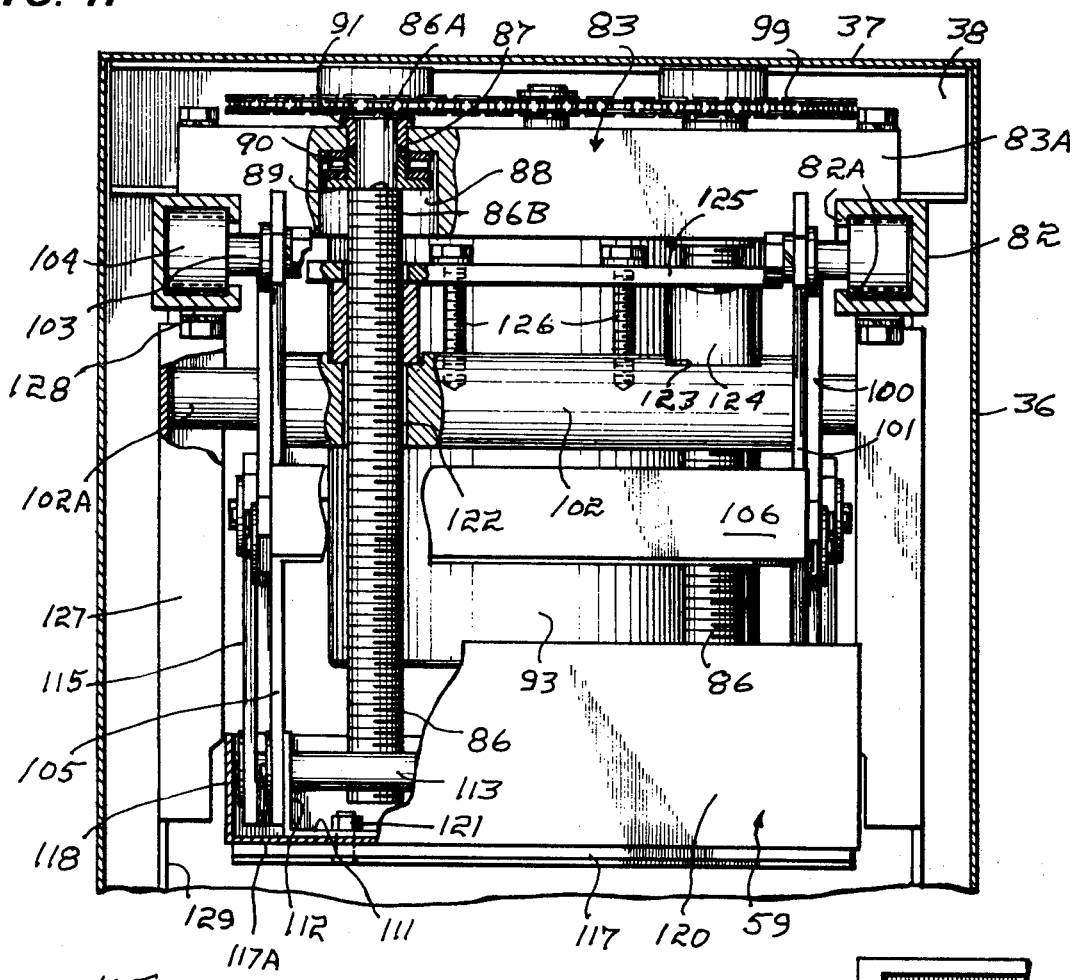
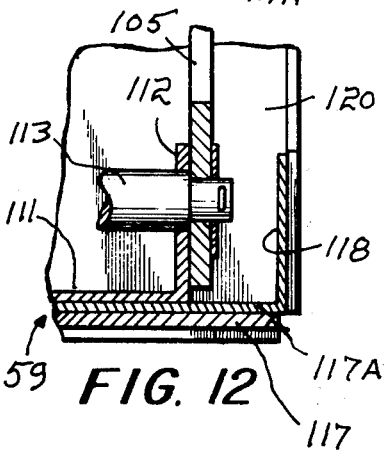
FIG. 12
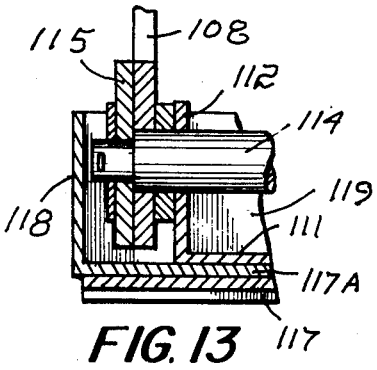
FIG. 13
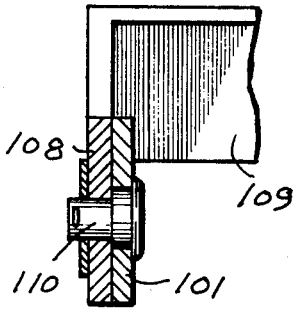
FIG. 14

TRASH COMPACTOR

The present application is a continuation-in-part of Ser. No. 515,675, filed Oct. 17, 1974, now abandoned.

BACKGROUND REFERENCES

U.S. Pat. No. 497,871
U.S. Pat. No. 1,459,656
U.S. Pat. No. 3,350,065
U.S. Pat. No. 3,659,427
U.S. Pat. No. 3,727,546

BACKGROUND OF THE INVENTION

Trash compactors for domestic use have been well received as they enable most all household trash to be so compacted within plastic bags as to reduce the bulk of the trash to about 25 percent of its original volume.

Of the various types of mechanisms employed to reciprocate compacting heads, screw feeds directly connected to the heads are well adapted for use although operating at relatively slow rates but with a constant pressure and with the heads held stable. Linkage systems actuated by a screw are also well adapted for use in compactors as they provide a more rapid rate of head travel but necessitate means to stabilize the heads against tilting in one direction or another when driven in contact with trash offering uneven resistance. Linkage systems used for various purposes often consist of two sets of interconnected links.

Domestic compactors also present problems in use. Trash is compacted in plastic bags within a holder and often, because of lateral expansion of the trash being compacted, the bag, the holder, or both are in sufficiently tight contact with the walls of the housing to make difficult the removal of the holder, the bag, or both.

As trash being compacted usually contains some article or articles capable of piercing the bags, it is not uncommon for a bag of compacted trash to rupture while being carried and, in addition, the bulk of such a bag results in its being carried in such a manner that sharp pieces may come in contact with and cut the person handling it or tear his clothing.

THE PRESENT INVENTION

A general objective of the present invention is to provide a trash compactor, particularly one for domestic use, having novel means to reciprocate the trash compacting head that combines desirable features of both types of mechanisms to which reference has been made, an objective attained by supporting the trash compacting head by linkage of a type that can be unfolded to extend it and then folded to shorten it. The linkage includes two sets of links connected to the head in a spaced-apart relationship. A pair of parallel, laterally spaced operating members are connected to the linkage and are operable to effect the folding and unfolding thereof to reciprocate the compacting head between its raised, inoperative position and compacting positions. A reversible drive connected to the operating members is operable to effect their movement together and to the same extent in both linkage-folding and linkage-unfolding directions, in the latter case, even if the resistance to the compacting head is unequal, in the direction defined by the connections between the linkage and the head. Stabilizing means connected to the compacting head hold it from tilting in a direction substantially at right angles to the first named direction.

Another objective of the invention is to utilize operating members that are screws and the two sets of links include interconnecting means with which the screws have spaced, threaded connections with their spacing and their common drive ensuring against jamming when the compacting head engages trash that is either unevenly piled in the trash receiver or offers uneven resistance to the downward travel of the head.

Another objective of the invention is to provide linkage in which both sets of links include first and second links pivotally connected between their ends by a transverse member with means connecting corresponding ends of the first and second links to supporting structure in the upper end of the compactor for movement towards and away from each other relative to a vertical plane inclusive of the transverse pivot member. The operating members are vertically mounted parallel screws and the transverse pivot member has nuts spaced lengthwise thereof through which the screws are threaded.

Another objective of the invention is to provide that the supporting structure includes tracks and the means connecting the first and second links to the supporting structure are track-engaging rollers.

Yet another objective of the invention is to provide that the means connecting the corresponding ends of the first and second links to the supporting structure are supporting links, one for each of the first named links and pivotally connected thereto and pivot means connect the supporting links to the supporting structure wiht a common axis in the vertical plane that includes the transverse pivot member.

Another objective of the invention is to provide linkage in which the links that are pivotally connected to the compacting head are third and fourth links pivotally connected, respectively, to the other ends of the first and second links and are downwardly inclined towards each other with their pivot connections with the head short of the plane. When the linkage consists of two sets of links, the ends of the pair of third links that are connected to the first links are rigidly interconnected as are the corresponding ends of the fourth links.

Yet another objective of the invention is to provide that the stabilizing means is at least one fifth link pivotally connected to one of the links interconnected by the member and extends through the plane and has a pivotal connection with the head that is coaxial with the link or links at that side of the plane.

Another general objective of the invention is to provide a trash receiving unit that will facilitate the handling of the bags when suitably filled with compacted trash, an objective attained by the use of a pan in which the bag is to be bottomed. A container open at both top and bottom has a frame surrounding its upper end and having its side walls outwardly and downwardly inclined and dimensioned to fit freely within the thus positioned bag and against the bottom of the pan thus not only to hold the bag against moving as the compacting head is reciprocated but also to shield the sides of the bag against being cut or torn while the trash therein is being compacted. Means are provided to detachably interconnect the pan and the container. The reverse taper of the container facilitates its withdrawal from the bag, when suitably full and enables the compacted trash to be easily dislodged from the container, should it adhere thereto, as the container is withdrawn from the bag. Desirably the pan and the container have means enabling a carrying strap to be secured to either one of them to enable the pan to be safely carried with the bag therein, either with or without the container in place.

Another objective of the invention is to provide a compactor in which compacting may occur in a zone above the bag, an objective attained by providing a throat between the inoperative position of the compacting head and the position occupied by the trash receiving unit. Trash to be compacted is introduced into the throat which is dimensioned to permit the passage of the head therethrough and is of a strength capable of withstanding pressures normally attendant the compacting of trash if within the walls of the throat and the pan and the container are so dimensioned that their walls are wholly shielded by the throat.

Yet another objective of the invention is to ensure that the receiver, when suitably filled with compacted trash, may be withdrawn easily from the compactor, an objective attained by dimensioning the pan and the container so that the walls of the pan are spaced from the walls of the compactor housing and from the walls of the container and providing that the walls of the pan and the container are of a plastic providing resilience and sufficient memory to ensure that, at the end of each compaction, their walls will not be permanently deformed to defeat the objective attained by their original shapes. Should the compacted load cause the sides of the pan to engage the walls of the housing, the plastic walls of the pan offer little frictional resistance as the unit is pulled outwardly.

An additional objective of the invention is to ensure that the container will not be so deformed as to lose the advantages of its reverse taper, an objective attained by forming its frame of tempered steel to ensure that it will regain its shape after each compacting stroke.

BRIEF DESCRIPTION OF THE DRAWINGS

Preferred embodiments of the invention are illustrated by the accompanying drawings of which

FIG. 5 is a side view of the compactor on a further increase in scale and with the side of its housing partly broken away;

FIG. 6 is a section taken approximately along the indicated line 6—6 of FIG. 5;

FIG. 11 is a section taken approximately along the indicated line 11—11 of FIG. 9;

FIG. 12 is a section taken approximately along the indicated line 12—12 of FIG. 9;

FIG. 13 is a section taken approximately along the indicated line 13—13 of FIG. 9;

FIG. 14 is a section taken approximately along the indicated line 14—14 of FIG. 9;

THE PREFERRED EMBODIMENT OF THE INVENTION

The embodiment of the compactor illustrated by FIGS. 1 – 21 of the drawings has its housing generally indicated at 25 and may be dimensioned to be incorporated with other units in a kitchen counter or counter-cabinet assembly, or as a free-standing unit.

Figure 7:
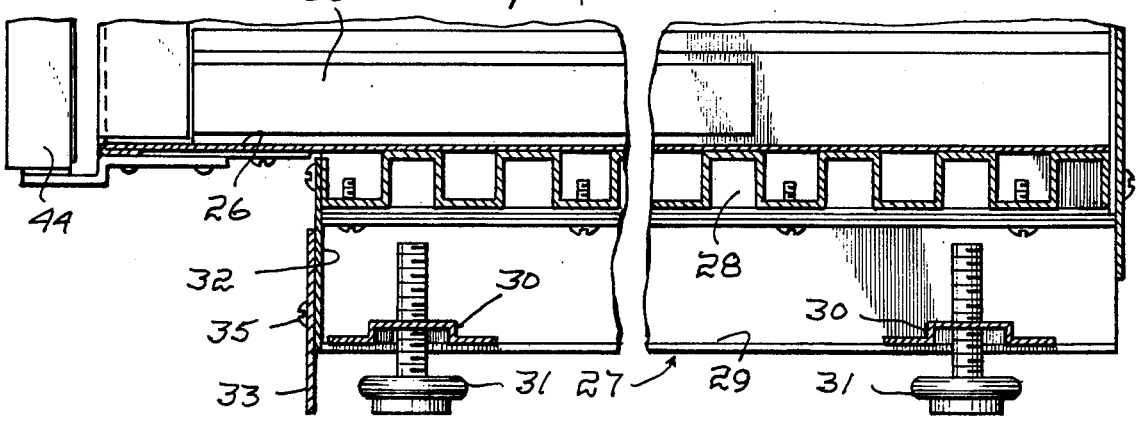
FIG. 7 is a section taken approximately along the indicated line 7—7 of FIG. 4 but on a substantial increase in scale.

The housing 25 has, see FIGS. 6 and 7, a floor plate 26 supported by a base, generally indicated at 27. The floor plate extends beyond the front end of the base 27 which has a corrugated bed 28 whose channels are ribs extend transversely thereof and whose ends rest on the upper walls of channel members 29 disposed to open towards each other. The margins of the floor plate 26 are turned under the bed 28 as at 26A. The lower walls of the channel members 29 are interconnected, adjacent their ends, by flanged stiffeners 30 with adjustable levelling legs 31 supported thereby and by the lower walls of the members 29. A fixed tow plate 32 is secured to the front of the bed 28 and is dimensioned to close the space defined by the channel members 29 and an adjustable toe plate 33 has vertical slots 34, see FIG. 4, through which extend screws 35 threaded into the plate 32 enabling the plate 33 to be adjusted relative to the floor on which the compactor rests after the adjustment of the levelling legs on the installation of the compactor.

The housing side walls 36 and the top wall 37 are integral parts of a metal sheet with the bottom edges 36A of the side walls inturned and clamped between the turned under margins 26A and the upper flanges of the channel members 29 and, forwardly of the base 27, secured to the floor plate 26.

Figure 1:
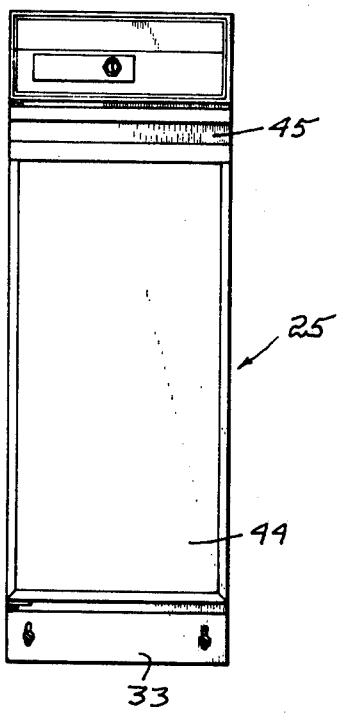
FIG. 1 is a front elevation of a compactor in accordance with the invention.
Figure 2:
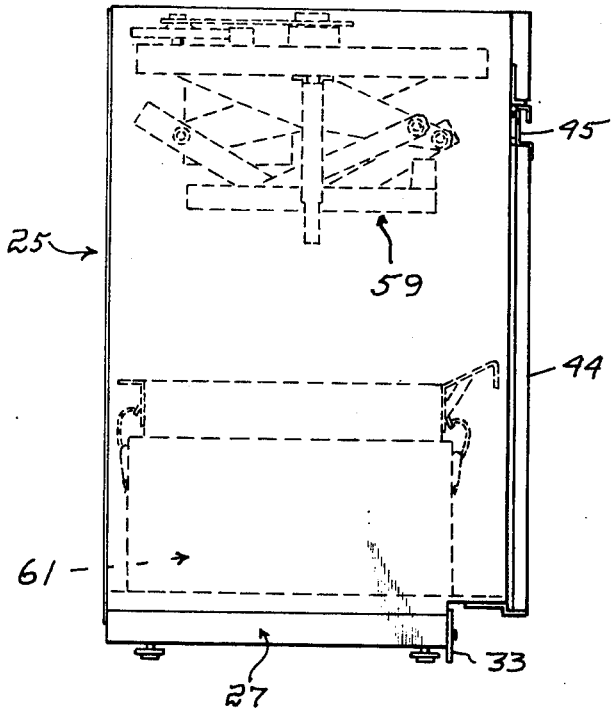
FIG. 2 is a side view of the compactor.
Figure 3:
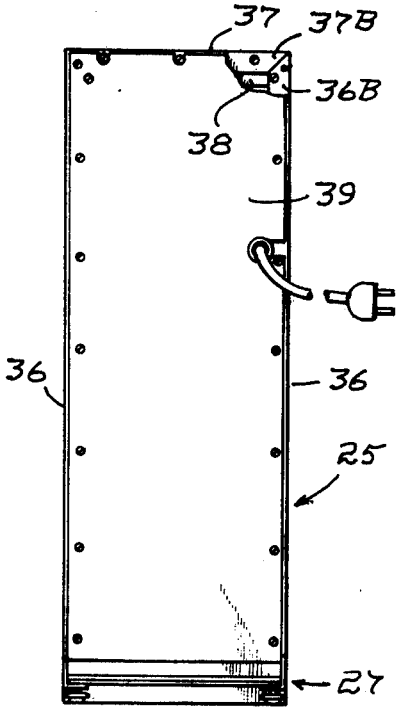
FIG. 3 is a rear elevation thereof.

As may be seen in FIG. 3, the rear edges 36B of the side walls 36 are bent inwardly and the rear edges 37B of the top wall 37 are bent downwardly with the proximate ends of said rear edges mitered. A channel member 38 extending transversely of the upper end of the housing 25 is secured to the inner surface of the rear edge 37B. A rear wall 39 is attached to the outer surfaces of the rear edges 36B and 37B.

Figure 4:
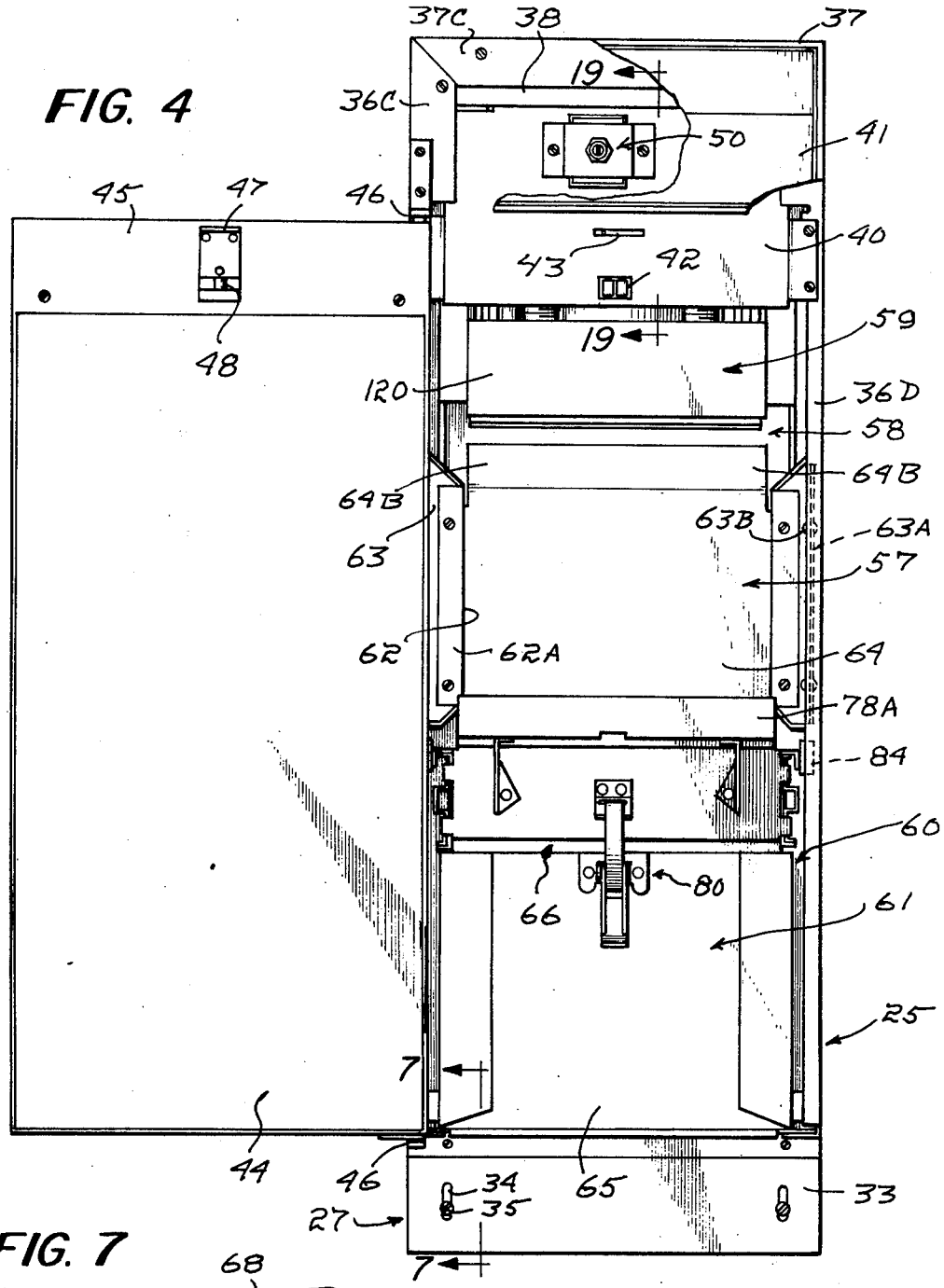
FIG. 4 is a front view of the compactor on an increase in scale with the door open and with the front panel partly broken away.

The front edge 37C of the top wall 37, see FIG. 4, is bent downwardly and the upper portions 36C of the side walls 36 are bent inwardly with the proximate ends of the edge 37C and the portions 36C mitered. A second transverse channel 38 is attached to the inner surfaces of the front edge 37C and to the mitered ends of the portions 36C. The remainder of each of the front edges of the side walls 36 is bent inwardly and then rearwardly to provide rigid margins 36D. A plate 40, below the channel 38, is secured against the inner surfaces of the front edge 36C and the inwardly disposed wall 36D. A panel 41, secured to the housing 25, covers the upper part of the plate 40, the lower exposed part of which has a catch 42 below a slot 43.

A door 44, provided with a handle 45 extending across its upper end, is secured to one side of the front of the housing 25 by hinges 46. As will be apparent from FIGS. 1 and 19, the door is dimensioned so that the handle 45 fits under the panel 41. A probe 47 and a latch 48 are mounted on the rear of the handle 45 with the probe 47 in a position to pass through the slot 43 and actuate the arm 49A of a normally open switch 49 thereby to close it when the door 44 is fully closed and the latch 48 releasably held by the catch 42.

Figure 19:
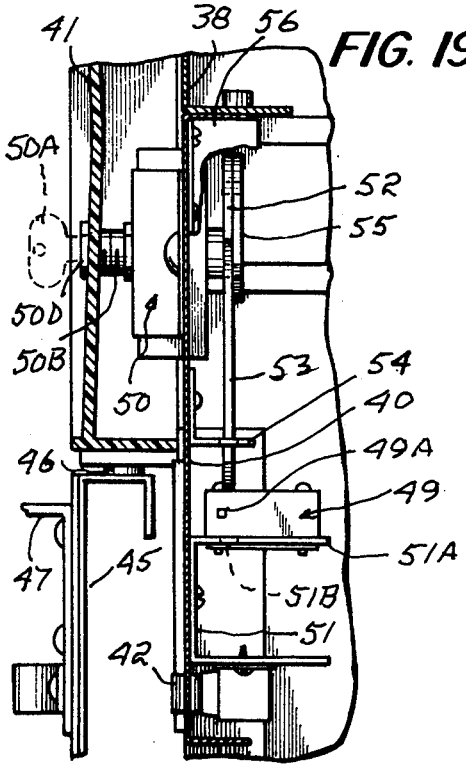
FIG. 19 is a section, on an increase in scale, taken approximately along the indicated line 19—19 of FIG. 4 and showing the door lock.
Figure 20:
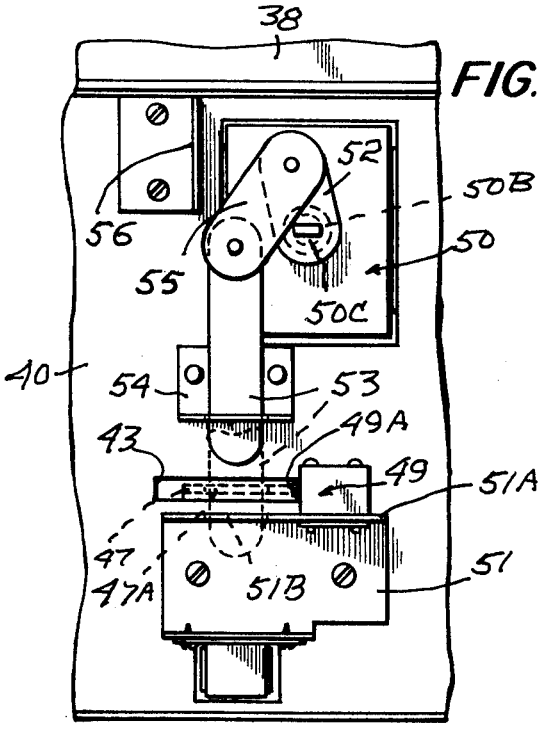
FIG. 20 is a rear view of the door lock.
Figure 21:
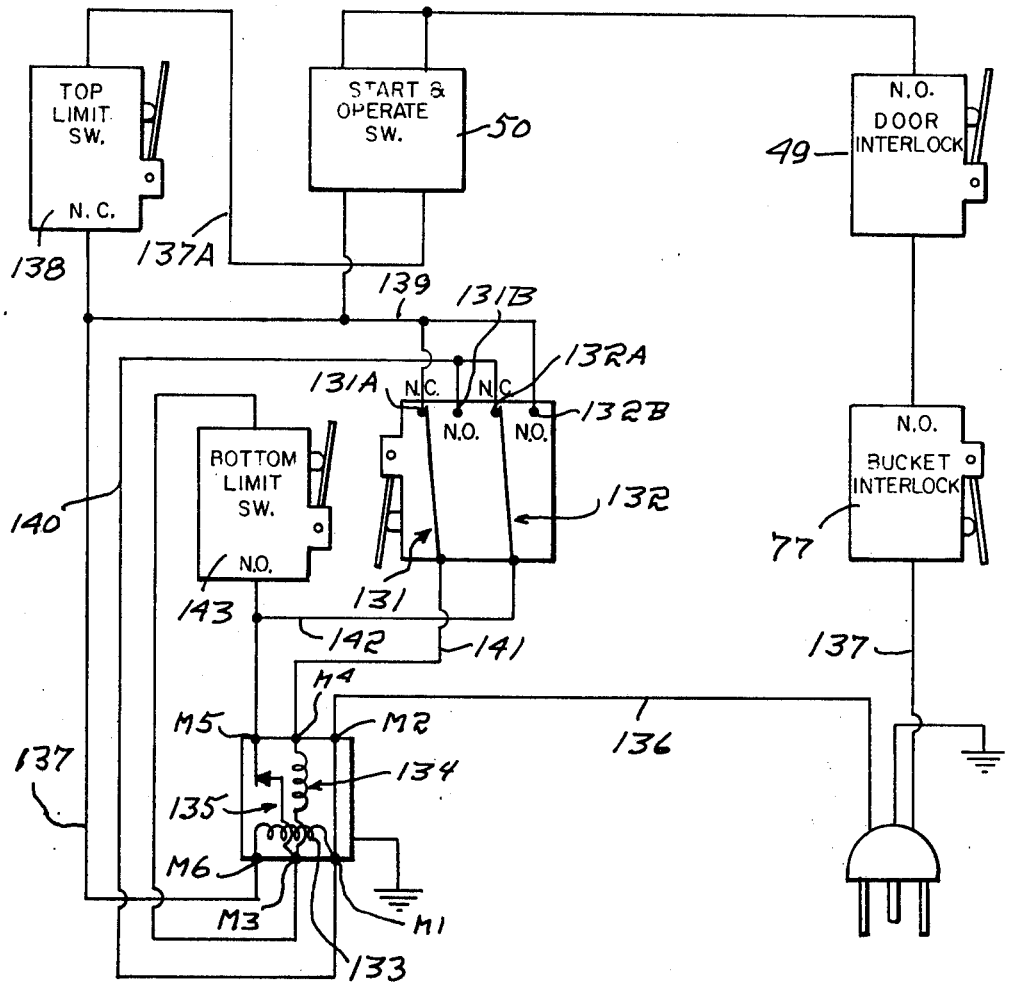
FIG. 21 is a schematic view of the electric circuit.

The operator controlled switch is generally indicated at 50 in FIGS. 19, 20, and 21 and is of the type operated by a removable key 50A and has three positions, an "off" position, an "on" position, and a "start" position. The key 50A must be held in the start position to keep it from returning to the on position as is conventional with such circuits as those of motor vehicles where the circuit to the starter is closed only when the ignition switch is held by the operator in the start position. The switch 50 is not detailed as, per se, it is not part of the present invention and is well known. Switches of this type are made by Ark-Les Switch Corp. of Watertown, Mass.

The switch 50 is mounted on the front face of the plate 40 with the sleeve 50B for the slotted shaft 50C extending through the panel 41 and secured by a nut 50D with the shaft 50C exposed to permit the key 50A to be inserted therein and then turned into its start position. As is conventional, the key 50A can be removed only when the switch 50 is in its off position.

While the operating circuit is subsequently described, the switch 50 has been here referred to because its operation has the additional function of operating a lock for the door 44. The probe 47 has a slot 47A and the normally open switch 49 is mounted on the upper transverse wall 51A of a U-shaped bracket 51 secured on the rear surface of the plate 40 below the slot 43 and the wall 51A has a lengthwise slot 51B. An arm 52 is mounted on the inner end of the shaft 50C to turn therewith. A locking member 53 is slidable vertically in a guide 54 mounted on the rear face of the plate 40 above the slot 43 with its upper end pivotally connected to a link 55 which is pivotally connected to the free end of the arm 52. The slots 47A and 51B are disposed and dimensioned to receive the locking member 53 when the door is so closed that the switch 49 is closed. When the switch 50 is in the off position, the locking member 53 is in its retracted position shown in full lines in FIG. 20 and, when the key 50A has been inserted in the locking member 53 and is in its on position, the locking member 53 is in its dotted line position, extending downwardly through the slots 47A and 51B that are in vertical alignment when the door 44 is closed and thus lock it. A stop 56 is mounted on the upper part of the plate 40 in a position to be engaged by the link 55 when the key 50A is turned into its off position.

The housing 25 has a throat, generally indicated at 57 dividing its interior into an upper portion, generally indicated at 58 in which the compacting head, generally indicated at 59, is located when in its upper, retracted position and a lower chamber, generally indicated at 60 for the trash-receiving unit generally indicated at 61 and presently to be detailed.

Figure 8:
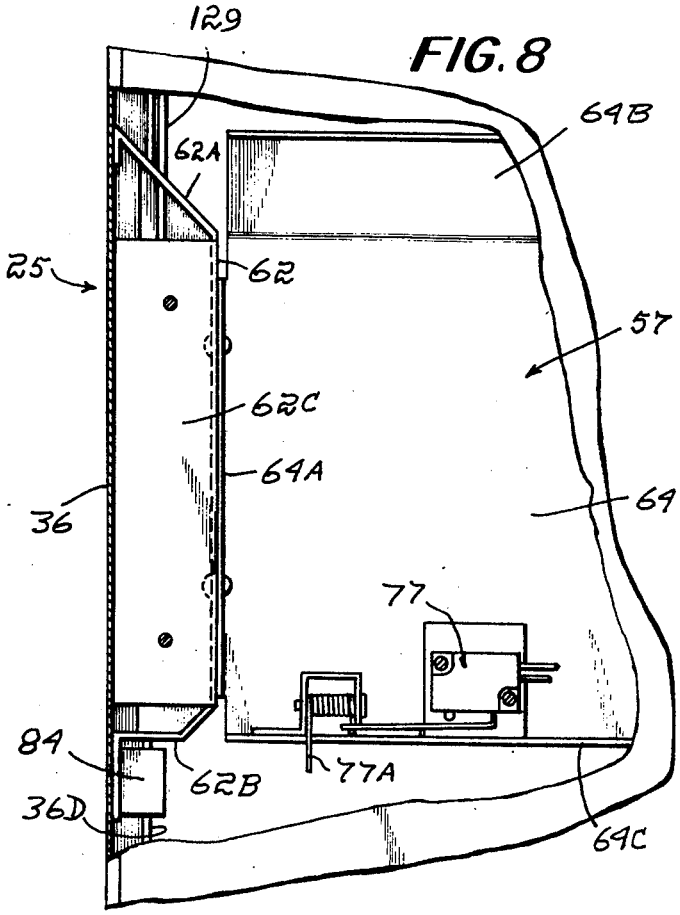
FIG. 8 is a fragmentary view, on an increase in scale, of the rear of the compactor with the rear wall of the housing broken away to show the throat.

Each side 62 of the throat 57, see FIGS. 4, 5, and 8, has its upper and lower margins 62A and 62B, respectively, inwardly and oppositely inclined and in engagement with the side walls 36. The ends 62C of each throat side 62 are bent inwardly with the rear ends 62C secured to the inturned margin 36B. A cover 63, see FIGS. 4 and 5 is secured to the front end 62C and each cover 63 has a flange 63A extending behind the appropriate inturned margin 36D and secured as by screws 63B. The throat 57 also includes a rear wall 64 with its ends 64A secured to the throat sides 62 with the rear wall 64 spaced from the rear wall 39 of the housing and its upper edge 64B is upwardly and rearwardly inclined and in engagement therewith as it its rearwardly disposed bottom edge 64C.

Figure 15:
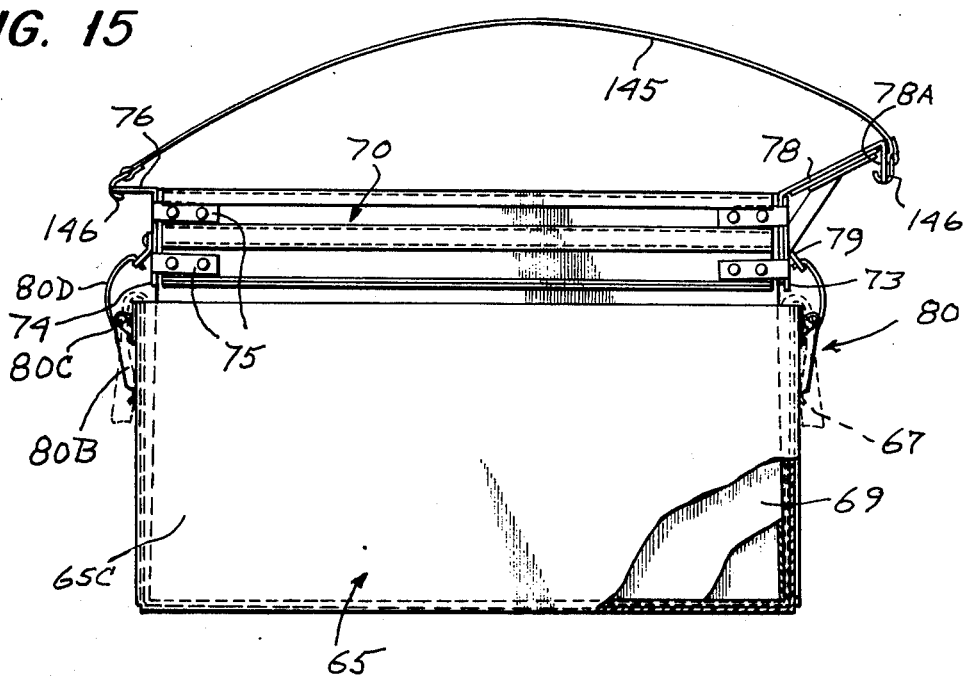
FIG. 15 is a side elevation of the trash receiving unit partly broken away to show the container and illustrating the carrying of the unit by means of a strap attached to the container.
Figure 16:
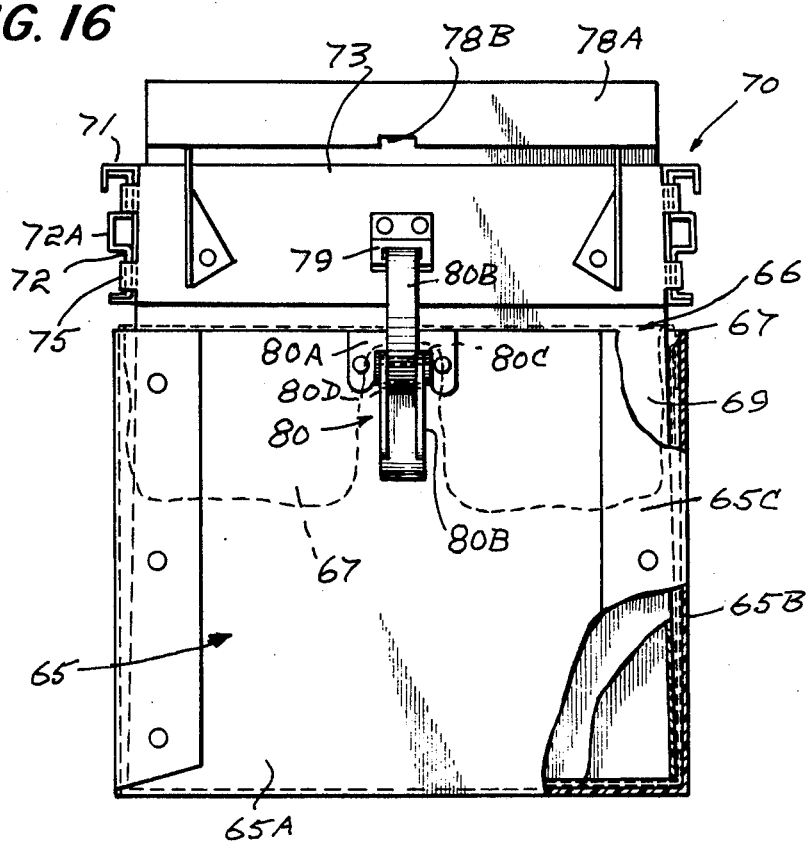
FIG. 16 is a partly sectioned front view of the unit, on an increase in scale.
Figure 17:
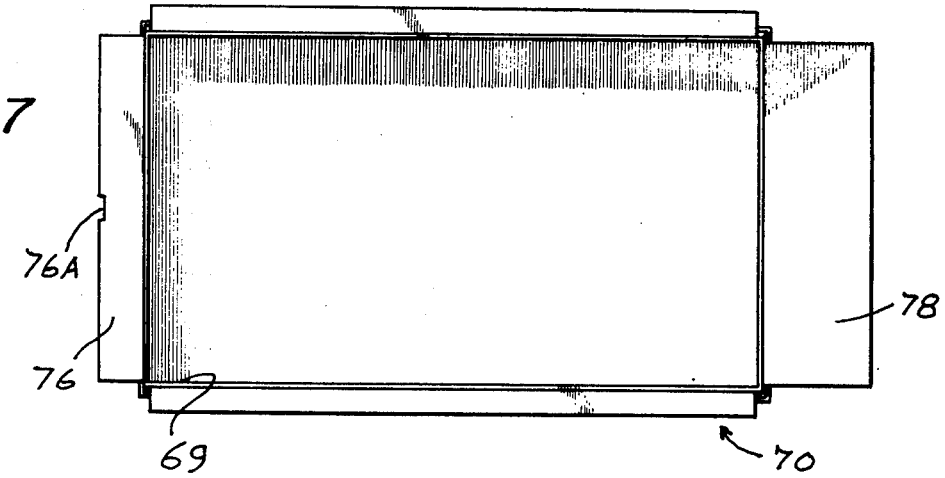
FIG. 17 is a top plan view of the trash receiving unit.

The trash receiving unit 61 consists of a pan and a container, generally indicated at 65 and 66, respectively, the pan 65 to receive the bottom part of a trash bag 67, FIGS. 15 and 16, with its upper part draped over the side walls of the pan, the container 66 to be entered into the thus disposed bag to seat the bottom thereof against the bottom of the pan 65. In practice, the portion of the bag draped over the sides of the pan 65 is then tucked in the space between the sides of the pan and the sides of the container. The unit 61 with its bag is then slid into the chamber 60 with the bottom portion of the pan 65 fitting between the guides 68, desirably of a plastic presenting a smooth anti-friction surface, one extending along each side 36 closely adjacent the floor plate 26, see FIGS. 6 and 7.

Figure 18:
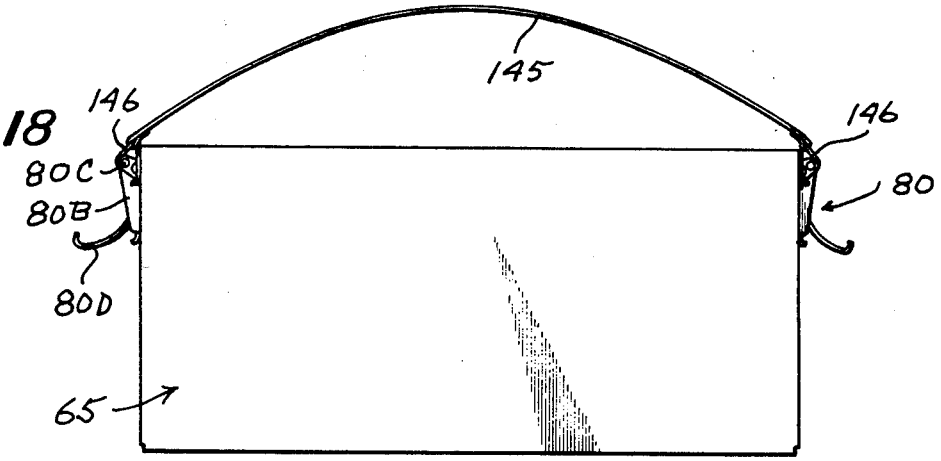
FIG. 18 is a side view of the pan with the carrying strap secured thereto.

The pan 65, see FIGS. 15, 16, and 18, is shown as including front and rear walls 65A and side walls 65B having end tabs 65C overlapping the walls 65A and riveted or otherwise secured thereto. As the pan 65 is dimensioned to be a sliding fit between the guides 68, its side walls 65B are spaced a substantial distance from the housing side walls 36 but its edges are shielded by the throat 57. The pan 65 is formed of a plastic that affords adequate wall strength and has memory characteristics such that it does not become so substantially permanently deformed in use as to interfere with the ease with which it may be entered into or withdrawn from the chamber 60. Polypropylene has proven satisfactory in practice.

The container 66 includes a rectangular plastic shell 69, open at the top and bottom and having a frame, generally indicated at 70, surrounding its upper end. Except for the upper shell end, the shell walls are outwardly and downwardly inclined with the departure, in practice, about 1½° from the vertical in order that the upper edges of the shell and the frame 70 may be shielded by the throat 57 and the bottom edges of the shell are a close but free fit within the bottom of the pan 65 with the shell 69 otherwise spaced from the pan 65. The frame 70 is dimensioned so that its outer edges are spaced from the walls of the housing, see FIG. 4.

The shell 69 is of a material providing flexibility and adequate wall strength and having memory characteristics with polypropylene having proved to be satisfactory.

The frame 70, see FIGS. 5 and 15 – 17, consists of side sections consisting of outwardly opening U-shaped members 71 and stiffeners 72, each stiffener 72 U-shaped and dimensioned to be a snug fit within the appropriate one of the members 71 and having a central rib 72A providing upper and lower channels. The members 71 and 72 are of tempered steel providing such resilience that the return of the frame to shape is ensured after each compaction with the consequential restoration of the shape of the shell 69. The frame 70 also includes a front and rear sections 73 and 74 both having a pair of tabs 75 at each end that are vertically spaced and disposed so that each may enter the end of the appropriate one of the vertically spaced channels of a stiffener 72. The frame sections, the stiffeners 72 and the tabs 75 are connected to the shell 69 as by rivets.

The rear frame section 74 has a flange 76 extending from end-to-end thereof that not only underlies the rear throat wall 64, see FIGS. 5 and 8, but also, when the trash receiving unit 61 is properly positioned within the chamber 60, serves as a probe to engage and actuate the operating arm 77A of a normally open switch 77 making, as will subsequently be fully detailed, the operation of the compactor otherwise impossible. The flange 76 has a centrally located notch 76A.

The front frame section 73 includes a handle 78 extending from end-to-end thereof and so outwardly and upwardly inclined that, should an attempt be made to place the unit 61 in the chamber 60, wrong end to, the handle 78 would engage the rear throat wall 64 and thus prevent the closing of the switch 77. In addition, the handle 78 serves as a trash guide at the open end of the throat 57 and it will be noted, see FIG. 5, that the proper position of the trash-receiving unit 61 is such that it is spaced a substantial distance away from the door 44. The downturned margin 78A of the handle has a centrally located notch 77B.

In order that the pan 64 and the container 65 may be positively interconnected, each of the end sections of the container frame 70 is provided with a slotted catch 79 and each end wall of the pan 65 is provided with a clamp generally indicated at 80 and desirably of a type having a mount 80A, see FIG. 16, secured to a pan end wall with one end of an operating arm 80B of U-shaped section connected thereto by a pivot 80C and with a resilient hook 80D pivotally connected to the operating arm 80B below the pivot 80C thus to tightly interconnect the pan and the container when, with the hooks 80D caught by a catch 79 the arms 80B are swung downwardly against the end walls of the pan 65. When the clamp 80 is released, the hook 80D hangs down exposing the pivot 80C.

In order to prevent the frame 70 from catching on the margins 36E at the open end of the housing 25 when it is being removed, guide strips 81 are secured to the side walls 36 to hold centered that part of the frame 70 forwardly of the path of the compacting head 59.

The mechanism for reciprocating the compacting head 59 is mounted in the upper end of the housing 25 and includes a supporting structure consisting of a pair of transversely aligned side supports 82, see FIG. 11, in the form of channels opening towards each other with their ends below and connected to the channel members 38. The margins of the side walls of the supports 82 are turned inwardly towards each other as at 82A so that the supports may serve as tracks extending lengthwise of the housing 25.

The side supports 82 have a centrally located support, generally indicated at 83, a rear end plate 84, and an intermediate mount 85, each resting on and secured thereto. The support 83 is shown as having shouldered ends 83A.

Two laterally spaced, vertical screws 86 have upper shaft ends 86A of reduced diameter defining a shoulder 86B. The support 83, has, adjacent each end, a bore 87 opening into a counterbore 88 in its undersurface. Each shaft end 86A extends upwardly through a flanged bushing 89 seated on its shoulder 86B with a roller bearing unit 90 confined between it and the bottom of the counterbore 88. Each shaft end 86A also extends through a flanged bushing 91 spaced from the bushing 89 with its flanged end between the upper surface of the support 83 and a sprocket 92 fixed on its shaft end 86A.

The intermediate mount 83 has a reversible motor 93 attached to its undersurface with its drive shaft 94 extending upwardly through the mount 85. A pinion 95 fixed on the upper end of the shaft 94 meshes with a larger gear 96 whose shaft 97 is vertically journalled in the end plate 84 and has a sprocket 98 fixed on its upper end. A chain 99 is trained about the sprocket 98 and the sprockets 92.

Figure 9:
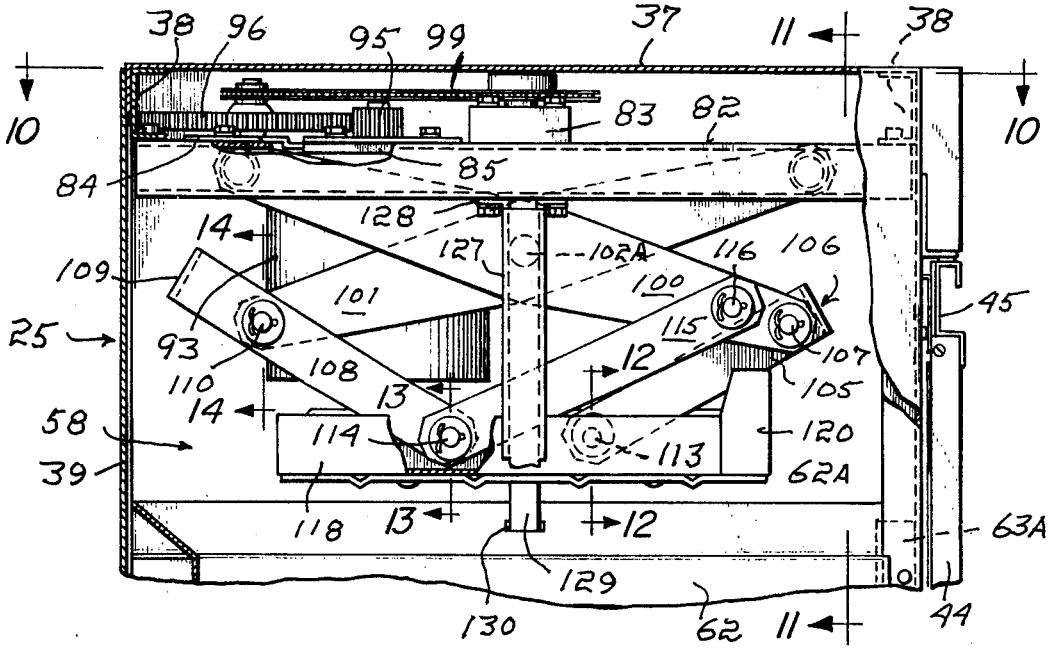
FIG. 9 is a fragmentary side view of the upper end of the compactor with the side wall of the housing broken away.
Figure 10:
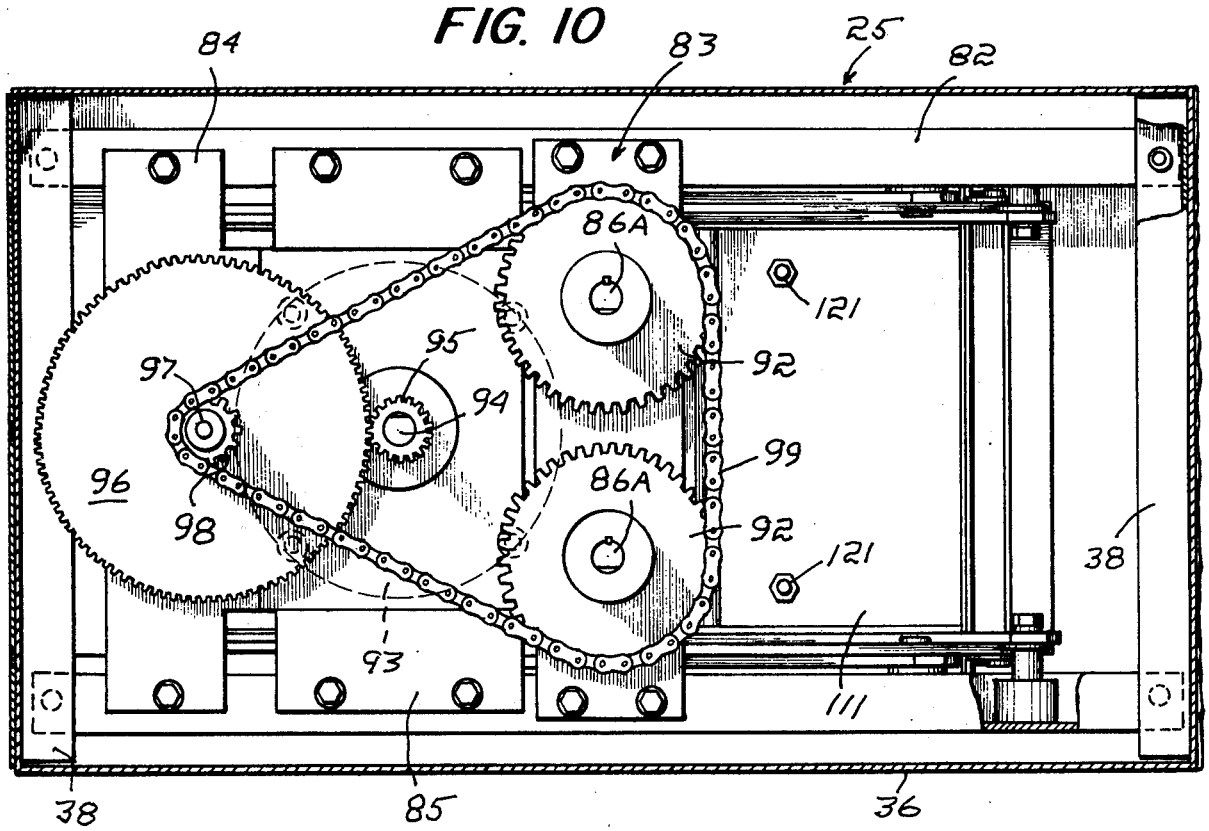
FIG. 10 is a section taken approximately along the indicated line 10—10 of FIG. 9.

The compacting head 59 is supported by linkage shown as consisting of two identical sets of links and best seen in FIGS. 5, 9, and 11. Each set includes first and second links 100 and 101, respectively. A cross rod 102 of substantial diameter has end portions 102A of reduced diameter, each end portion serving as a pivot to centrally interconnect the links 100 and 101 of each set to function as scissors. Corresponding ends of the links 100 and 101 of both sets are provided with stub shafts 103, see FIG. 11, extending between the margins 82A of the side supports 82 and provided with rollers 104 resting on the tracks that the supports 82 establish. Links 105 which are the arms of a U-shaped member 106 are connected by pivots 107 adjacent their interconnected ends to the other ends of the link 100 and link 108 which are the arms of a U-shaped member 109 and are connected by pivots 110 adjacent their interconnected emds to the other ends of the links 101.

The compacting head 59 includes a mounting plate 111 having side walls 112 and the links 105 and 108 are downwardly inclined towards each other with the links 105 pivotally connected to the ends of a cross rod 113 supported by the side walls 112 on the same side of a vertical plane inclusive of the axis of the rod 102 as the pivots 107 and the links 108 are pivotally connected to the ends of a cross rod 114 supported by the side walls 112 on the opposite side of that plane. Stabilizing links 115 are connected by pivots 116 to the links 100 adjacent the pivots 107 and extend downwardly through said plane and are pivotally connected to the cross rod 114 of the mounting plate 111.

The compacting head 59 also includes a breaker plate 117, a pan 117A provided with side walls 118, a rear end wall 119, and a front wall 120 disposed and dimensioned to enable the mounting plate 111 to be bottomed in the pan 117A and the breaker plate 117, the pan 117A and the mounting plate are interconnected by bolts 121. It will be noted that the front wall 120 of the pan 117A is of substantial height thus to prevent trash from entering above the compacting head 59 when the compacting head is in its raised inoperative position.

The cross rod 102 has vertical bores 122 located near its end and dimensioned to freely receive the screws 86 with the bores 122 opening upwardly through transverse channels 123. Each channel 123 receives a nut 124 through which the appropriate one of the screws 86 is threaded and which holds that nut against turning. The nuts 124 are held captive by a bar 125 held against their upper ends by screws 126 connecting the bar to the cross rod 102.

It will be apparent from the foregoing, that when the drive is operating to so rotate the screws 86 as to lower the cross rod 102, the linkage will be extended to advance the compacting head 59 from its inoperative position, FIGS. 9 and 11, to an operative compacting position, that shown in FIG. 5, for one example. When the drive is reversed, the screws 86 draw the cross rod 102 upwardly with the linkage folded and the compacting head 59 returned to its inoperative position. It will be noted that a vertical channel 127 is located at each side of the housing 25. Each channel 127 receives and serves as a slideway for an end portion 102A of the cross rod 102 and has flanges 128 at its upper end anchored as by screws to the flanges 82A of the side supports 82. Each channel 127 has a tab 129 at its lower end extending downwardly through a slot 130 in the upper edge 62A of a throat side 62 and is thereby anchored.

The operation of the compactor is described in conjunction with the operating circuit, see FIG. 21. The motor 93 is a conventional, reversible one-third H.P. 115V AC motor having direction control switches 131 and 132. The running windings 133 of the motor are located between the motor terminals M6 and M1, the starting windings 134 are between the motor terminals M3 and M4, and a centrifugal switch 135 is between the terminals M5 and M3. The centrifugal switch 135 is closed when the motor speed is below a certain rate and is open when that rate is exceeded.

The circuit includes leads 136 and 137, the lead 136 the ground and connected to the motor terminal M1 and the lead 137 connected to the motor terminal M6 and including the normally open switch 77 closed when the trash receiving unit 61 is properly positioned within the chamber 60 and the normally open switch 49 closed when the door is shut. The lead 137 also includes the operator controlled switch 50 and is closed only when the key 50A is turned into its start position. A parallel lead 137A is closed when the key 50A is in either its start or its on position and includes a normally closed limit switch 138 positioned to be held open when the compacting head 59 is in its uppermost position but closing when its downward travel is initiated when the key 50A is turned into and momentarily held in its start position.

The lead 137 has a branch 139 having parallel connections with the contact 131A of the direction control switch 131 and the contact 132B of the direction control switch 132. A lead 140 to the terminal M1 has parallel connections with the contact 131B of the switch 131 and the contact 132A of the switch 132. The switch 131 is connected to the terminal M4 by a lead 141 and the switch 132 is connected to the terminal M5 by a lead 142.

In the normal position of the switch 131, the branch 139 and the lead 141 are connected and in the normal position of the switch 132 and the leads 140 and 142 are connected to effect circuit flow through the starting winding 134 to cause the motor 93 to operate in a direction such that the compacting head 59 will be retracted. The switches 131 and 132 are located to be shifted and held from their normal positions by the compacting head 59 slightly in advance of its reaching its uppermost position and then opening the switch 138 to terminate the operation of the motor 93. When held in their thus shifted positions, the switch 131 connects the leads 140 and 141 and the switch 132 connects the branch 139 and the lead 142 to reverse the current flow through the starting winding 134 to cause the motor 93 to be driven in a direction in which the compacting head 59 is forced downwardly.

Should the trash within the unit 61 offer sufficient resistance to cause the speed of the motor 93 to drop to the level at which the switch 135 closes, the motor is reversed since the switches 131 and 132 are in their normal positions. A normally open limit switch 143 is located in a position to be closed when the compacting head 59 reaches a predetermined bottom position. The switch 143 is in a lead 144 connected to the motor terminal M3 and the lead 142 and is in a lead 144 connected to the motor terminal M3 and the lead 142 and is thus operable to effect a reverse flow through the starting winding 134 independently of the centrifugally operated switch 135 when the switches 131 and 132 are in their normal positions.

In the use of the compactor, the bottom part of a bag 67 is placed in the pan 65 with its upper part draped over the pan walls. The container 66 is inserted in the bag 67 and is seated against the bottom of the pan 65 and the parts of the bag that are draped over the side walls of the pan are tucked into the space between them and the upper part of the side walls of the container 66 that results from the reverse taper of the container. The container 66 is locked to the pan 65 by means of the clamps 80. The thus assembled trash receiving unit 61 is slid into the chamber 60 until its flange 76 butts against the rear wall of the housing 25, the switch 77 then being closed.

Trash may then be deposited in the unit 61 until it is so filled that the deposited load should be compacted. The door 44 is then closed and, as a result, the switch 49 is closed. If the key 50A is not in the switch 50, it is inserted and turned into the start position with the locking member 53 then advanced through the probe slot 47A and into the slot 51B of the anchor 51 thus locking the closed door 44. It is, of course, only necessary to hold the key 50A in the start position for a moment until the compacting head 59 has moved the short distance required to free the normally closed top limit switch 138 which the compacting head 59 holds open in its uppermost position. Once the compactor has started to travel the key 50A is released to permit its return to its on position. The compactor head 59 continues downwardly to compact the trash until the resistance is such that the overload on the motor 93 causes its reversal thus to retract the compacting head 59 until it reaches its uppermost position where it opens the normally closed switch 138.

It will be noted that uncompacted trash may extend upwardly into the throat 57 because it is of adequate strength to withstand the lateral forces resulting during a normal compaction. It is preferred that a compacted load does not extend much above the container 66.

When the unit 61 contains a suitable load of compacted trash, the key 50A is turned into its off position to unlock the door 44 and, desirably, the key is removed. With the door open, the unit 61 may be easily pulled by the handle 78 from the chamber 60 and the ease with which it is removed is attributable to several factors.

While the construction of the pan 65 and the container 66 has been detailed, the importance of their features will now be more apparent. The walls of the pan are originally dimensioned to be spaced from the walls of the housing 25 and the construction of the container 66 is such that its walls are spaced from those of the pan. The walls of both the pan and the container are flexible and both tend to recover their original shape. Because the frame 70 of the container 65 is of tempered steel, it not only always recovers its original shape after a compaction but biases the plastic shell 69 to return to its original shape. It will be noted, see FIG. 5, that when the linkage has been fully extended, the compacting head 59 is but a short distance below the frame 70. As the pan does not have a frame, its side walls may become somewhat outwardly bowed.

It is evident that the container 66 protects the bag 67 from the trash and that its construction permits its walls to flex in response to the pressures attendant a compaction. If such flexing is sufficient to engage and force and hold the walls of the pan 65 against the side of the housing 25, the plastic from which the pan 65 is made offers little frictional resistance when the unit 61 is being pulled from the chamber 60.

In order that the bag 67 with a compacted trash load therein may be safely and easily carried to the disposal or pick-up site, it is not removed from the unit 61. Instead, the unit 61 may be carried to the selected site and the bag 67 there removed after releasing the clamps 80 and withdrawing the container 66 therefrom or releasing the clamps 80 when the unit 61 is removed from the compactor and then withdrawing the container 66, the pan 65 then being carried to the selected site with the trash-filled bag 67 confined therein.

For convenience in carrying a bag 67 in either of the above described ways, a carrying strap 145 having a hook 146 at each end is provided. If the unit 61 is to be carried by the strap 145 to the selected site, one hook 146 is caught in the notch 78B of the handle of the container 66 and the other hook 146 caught in the notch 78A of the rear flange 76. If only the pan 65 and the bag 67 are to be carried to the site, the hooks 146 are caught under the pivots 80C of the clamps 80.

It should be noted that the container 66, due to the construction and shape of its shell 69 is easily withdrawn from the bag 67 in spite of the load of compacted trash therein. Should the load adhere to the shell 69, it is easily dislodged by shaking the container 66 as the container is being withdrawn. While the container 66 protects the walls of the bag 67 during a compaction, the walls of the pan 65 not only support and confine the bag 67 once the container 66 is removed but also serve as a shield between it and the person carrying it thus minimizing the chances of a ruptured bag and preventing injury or torn clothing while the trash-filled bag is being carried to the selected site.

Figure 22:
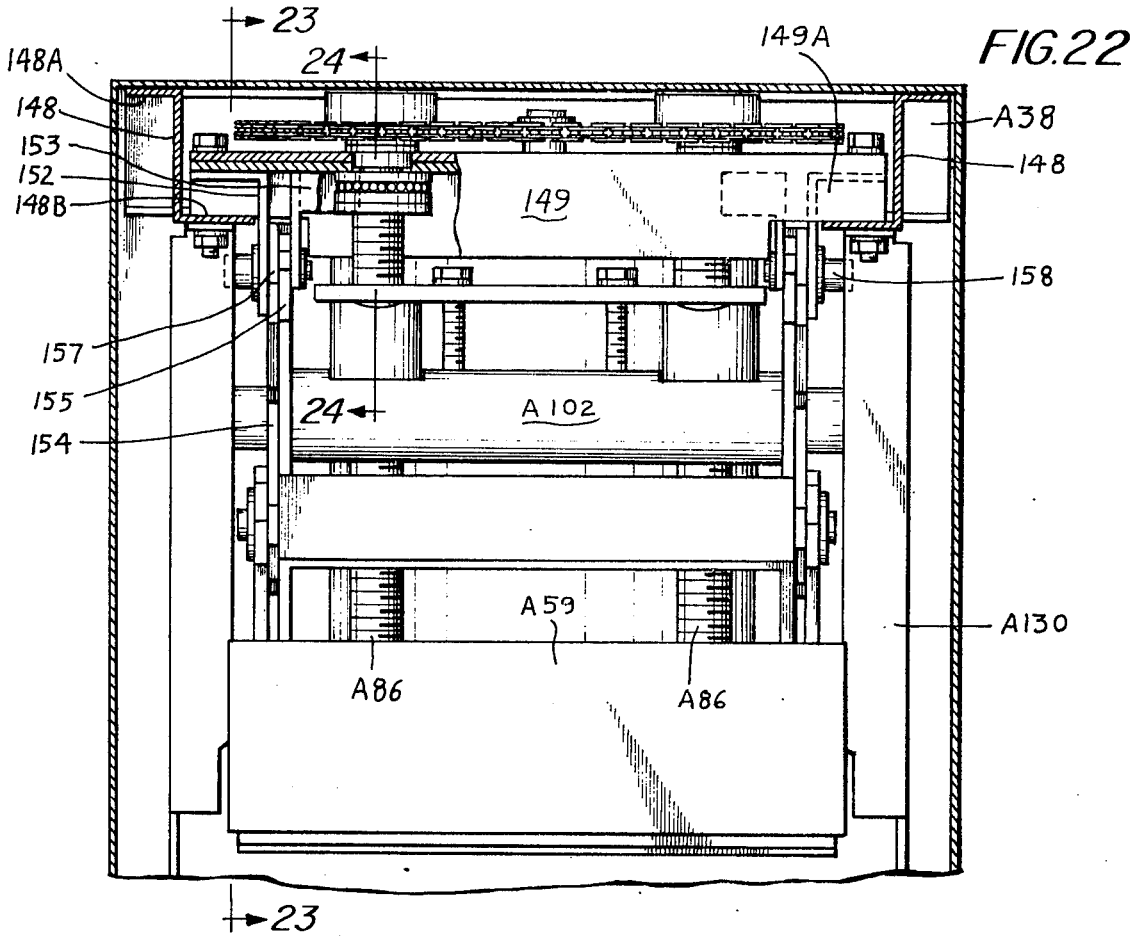
FIG. 22 is a view, similar to FIG. 9, but illustrating another embodiment of the invention.
Figure 23:
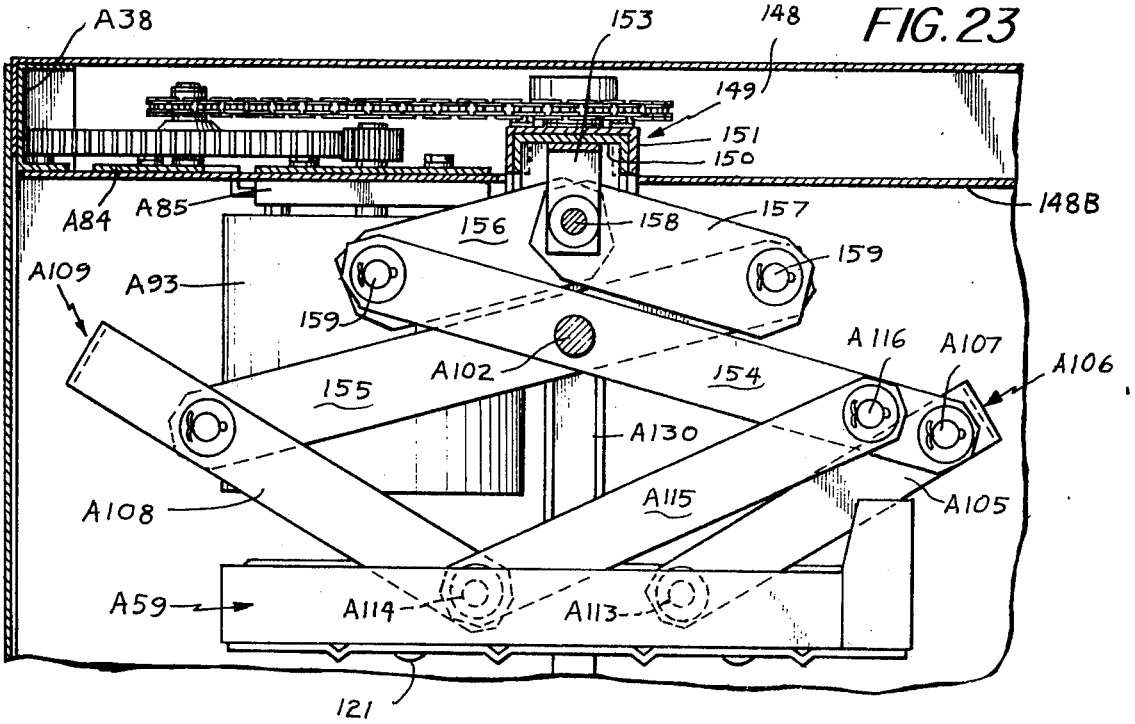
FIG. 23 is a section taken approximately along the indicated line 23—23 of FIG. 22.
Figure 24:
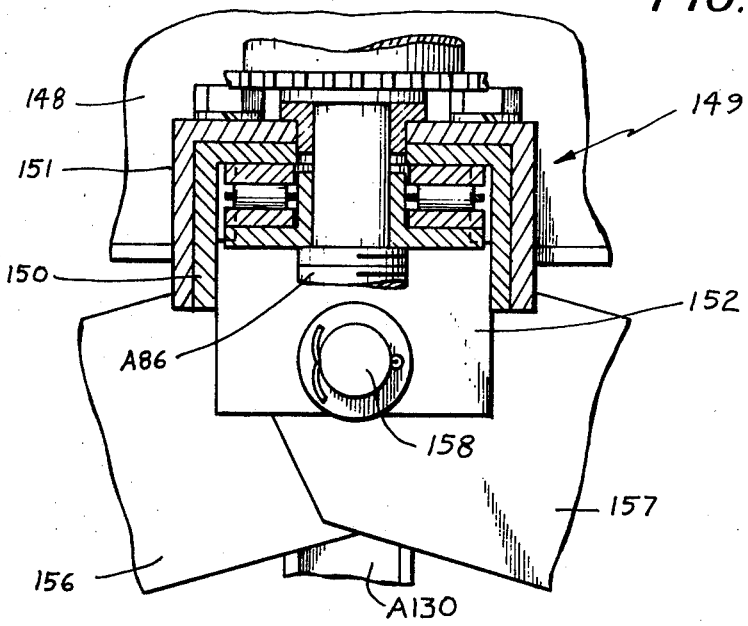
FIG. 24 is a section, on an increase in scale, taken approximately along the indicated line 24—24 of FIG. 22.

Reference is now made to the embodiment of the invention illustrated by FIGS. 22 – 24 which differs from that illustrated by FIGS. 1 – 20 as to the linkage and its support. Like parts are identified by the prefix addition A to the appropriate reference numbers and such parts are not again described.

The mechanism for reciprocating the compacting head A59 includes a pair of transversely aligned side supports 148 each having an outwardly disposed upper flange 148A and an inwardly disposed lower flange 148B extending at each end for attachment to the undersurface of the lower flanges of the channel members A38.

The side supports 148 have a centrally located support, generally indicated at 149, supporting the screws A86 in the same manner as the screws 86 of the previously described emnbodiment, a rear end plate A84 and an intermediate mount A85. The support 149 is shown as having a downwardly opening channel member 150 fitting within and welded to a similarly disposed channel member 151 with the ends of both cut away to provide shoulders 149A resting on the flanges 148B of the side supports and bolted thereto.

A bracket 152 is welded in each shoulder-establishing end of the channel 150 in a position close to the vertical channel A130 and U-shaped mounts 153 are welded in the channel 150 adjacent each bracket 152. In this embodiment of the invention, the first and second links 100 and 101 are replaced by shorter first and second links 154 and 155, corresponding ends of which are pivotally connected to the links A105 and A108, respectively, and their other ends are connected respectively to supporting links 156 and 157. The links 156 and 157 of each set of links are interconnected by a common support pivot 158 supported by the brackets 152 and the mounts 153 in transverse alignment and in the vertical plane that includes the axis of the member A102.

It will be noted that the supporting links 156 and 157 have the center of the pivot 158 and the centers of their pivotal connection 159 with the appropriate one of the links 154 and 155 above their longitudinal center lines. In FIGS. 22 and 23, the compacting head A59 is in its raised, inoperative position and it will be seen that the links 156 and 155 and the links 157 and 154 are closely spaced parallel vertically aligned pairs.

It will be recalled that the motors are self-reversing if the motor speed drops to a predetermined extent and that the compacting cycle is terminated by the limit switch 138 when the compacting head reaches its inoperative position. Should the limit switch 138 fail to function, for example, damage is prevented since immediately the proximate edges of the vertically aligned pairs of links 165, 155 and 157, 154 come into vertical contact causing the motor to reverse before pivots can cause links to become jammed. The drive will, of course, continue to reciprocate the compacting head until the switch 50 is opened so that the trouble can be corrected.

It will thus be apreciated that compactors in accordance with the invention are well adapted to meet compacting requirements and at the same time afford the user with convenience and safety in handling bagged, compacted trash.

We claim:

1. A compactor for compacting trash in a receiver, said compactor comprising a housing including an upper portion provided with structure having a central transverse support, an intermediate throat, a bottom portion for a receiver and of a cross sectional area greater than that of the throat, and a door permitting access to said throat and said bottom portion, a trash compacting head dimensioned to pass through said throat, two sets of transversely spaced, pivotally connected linkages of the lazy tongs type, means connecting the uppermost pair of links of both sets to said structure for movement towards and away from each other, and the lowermost links having their lower ends within the head, means pivotally connecting said lower ends thereto, means pivotally interconnecting the two sets of links and including a cross rod which extends through the centers of the uppermost pair of links of the two sets, vertical screws between said sets, one adjacent each set and having a threaded connection with said cross rod and with its upper end extending through and rotatably supported by said transverse support, and a drive attached to said supporting structure and including a reversible motor and members rotated by said motor, one member for each screw and fixed on the upper end thereof, said drive operable to effect the turning of the screws together in one direction to unfold the linkage and in the other direction to fold it thereby to reciprocate said head between an inoperative position adjacent the upper end of said throat and the lower ends of said screws, and an operative position within said bottom portion, said head including walls which at least at the front are of a height preventing the entrance of trash thereabove when said head is in said inoperative position.

2. The trash compactor of claim 1 in which each set of links includes first and second links which are the uppermost pair of links and the third and fourth links which are the lowermost pair of links and which are downwardly inclined with their lower ends close to but short of a vertical plane inclusive of the axis of said transverse rod, and a stabilizing link pivotally connected to corresponding ones of the uppermost pair of links adjacent their connection with the appropriate ones of the lowermost pair of links, said stabilizing links extending through said vertical plane and pivotally connected to said head with their pivot axes coaxial with those of the lower ends of the lowermost links on the same sides of said plane.

3. The trash compactor of claim 2 in which the means connecting the ends of the first and second links to the supporting structure are supporting links, one for each of the first named links and pivotally connected to an end thereof, and pivot means carried by said central support connecting the other ends of said supporting links thereto.

4. The trash compactor of claim 1 and a vertical guide at each side of the housing in said plane, the upper ends of said guides connected to said central support and the lower ends thereof connected to the throat at the sides thereof, and the ends of the cross rod are slidably connected to said guides.

5. The trash compactor of claim 1 in which the reversible motor depends from the structure adjacent the rear of the housing, the third and fourth links of both sets include integral connecting portions at their upper ends, and the fourth links straddle the motor in the inoperative position of the head.

6. The trash compactor of claim 1 in which the throat includes side and rear end portions each spaced from the corresponding wall of the housing and including marginal portions connected thereto, said throat portion of a construction capable of withstanding compacting pressures in the event trash not only fills the receiver but is present in the throat.

7. The trash compactor of claim 1 in which the compacting head includes a mounting plate provided with side walls to which the pivot ends of the cross rods are connected and a breaker plate including side and front end walls within which the mounting plate fits and means detachably connecting the two plates.

8. The compactor of claim 1 in which the motor is of a type provided with means effecting reversal of its direction in response to a condition indicator of a predetermined resistance to movement of the compacting head in either direction and the motor circuit includes a limit switch operable when the head is in a predetermined raised inoperative position to open said motor circuit, at least one pair of transversely aligned supporting links and the links which are connected to the supporting links defining a vertically aligned pair of links for each set that are substantially parallel in said inoperative position and so closely spaced as to become engaged, should said limit switch fail to function, then to establish said condition with the motor then reversing.

9. The compactor of claim 1 in which the pivot centers at the ends of said pair of supporting links are located above the longitudinal center lines thereof.

10. The trash compactor of claim 1 in which said structure includes members connecting said transverse support to opposite walls of said housing and operable to transmit thereto reactive forces developing as said compacting head encounters trash in the receiver.

11. The trash compactor of claim 10 in which said opposite walls are the end walls of the housing.

12. The trash compactor of claim 11 in which said structure includes members extending both lengthwise and transversely of the housing, the transverse members the members connected to the opposite housing walls.

13. The trash compactor of claim 12 in which the lengthwise members are channels opening towards each other and the means connecting the upper ends of the uppermost pair of links are rollers secured thereto and rotatably supported by the channels for movement therealong.

14. The trash compactor of claim 12 in which the side members engage the top wall of the housing substantially at the junction of the side walls therewith.

15. The trash compactor of claim 14 in which each side member includes an inwardly disposed bottom flange to which the support is connected and an outwardly disposed top flange substantially in engagement with the top wall of the housing.

* * * * *